United States Patent [19]

McNeill

[11] 4,068,971

[45] Jan. 17, 1978

[54] UNIVERSAL COIL CARRIER

[75] Inventor: Walter W. McNeill, Toronto, Canada

[73] Assignee: Bundy Corporation, Detroit, Mich.

[21] Appl. No.: 667,291

[22] Filed: Mar. 16, 1976

[51] Int. Cl.[2] ..... B65H 75/20

[52] U.S. Cl. ..... 294/67 R; 242/129; 242/77.2; 206/507

[58] Field of Search ..... 294/67 R, 67 C, 86 CG, 294/87 SH; 206/507, 513, 505; 211/24, 49, 181; 214/6 N, 130 C, DIG. 3, DIG. 4; 242/129, 77.2, 79, 80, 83

[56] References Cited

U.S. PATENT DOCUMENTS

| | | | |
|---|---|---|---|
| 3,021,010 | 2/1962 | McMasters | 242/129 |
| 3,139,986 | 7/1964 | Strock | 242/129 |
| 3,778,000 | 12/1973 | Breuner et al. | 242/77.2 |

FOREIGN PATENT DOCUMENTS

| | | | |
|---|---|---|---|
| 736,788 | 6/1966 | Canada | 206/507 |

*Primary Examiner*—James B. Marbert
*Attorney, Agent, or Firm*—Harness, Dickey & Pierce

[57] ABSTRACT

There is disclosed a coil carrier of relatively simple tubular construction for receiving, storing and transporting coils of tubing or the like which are wound therearound, the carrier being of such a design that a plurality of carriers may be stacked upon one another, with or without coils disposed thereon, or may be compactly nested with respect to one another. Means are also provided for lifting the carrier by lifting forks or by a lifting hook.

14 Claims, 6 Drawing Figures

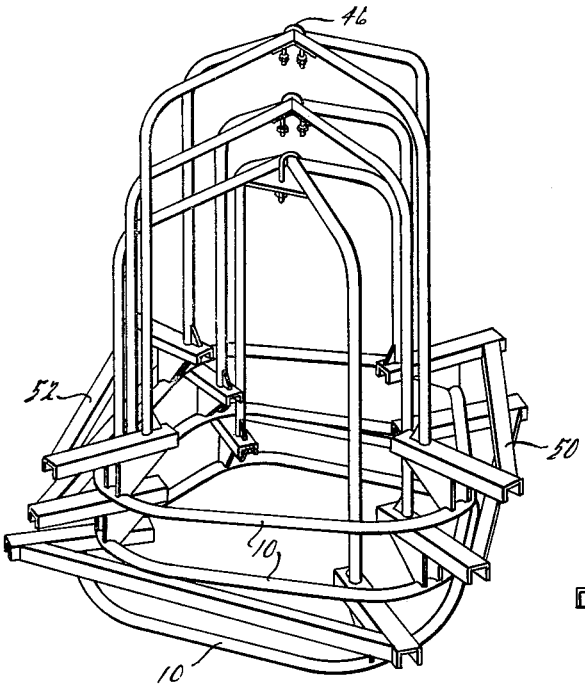
FIG. 4.
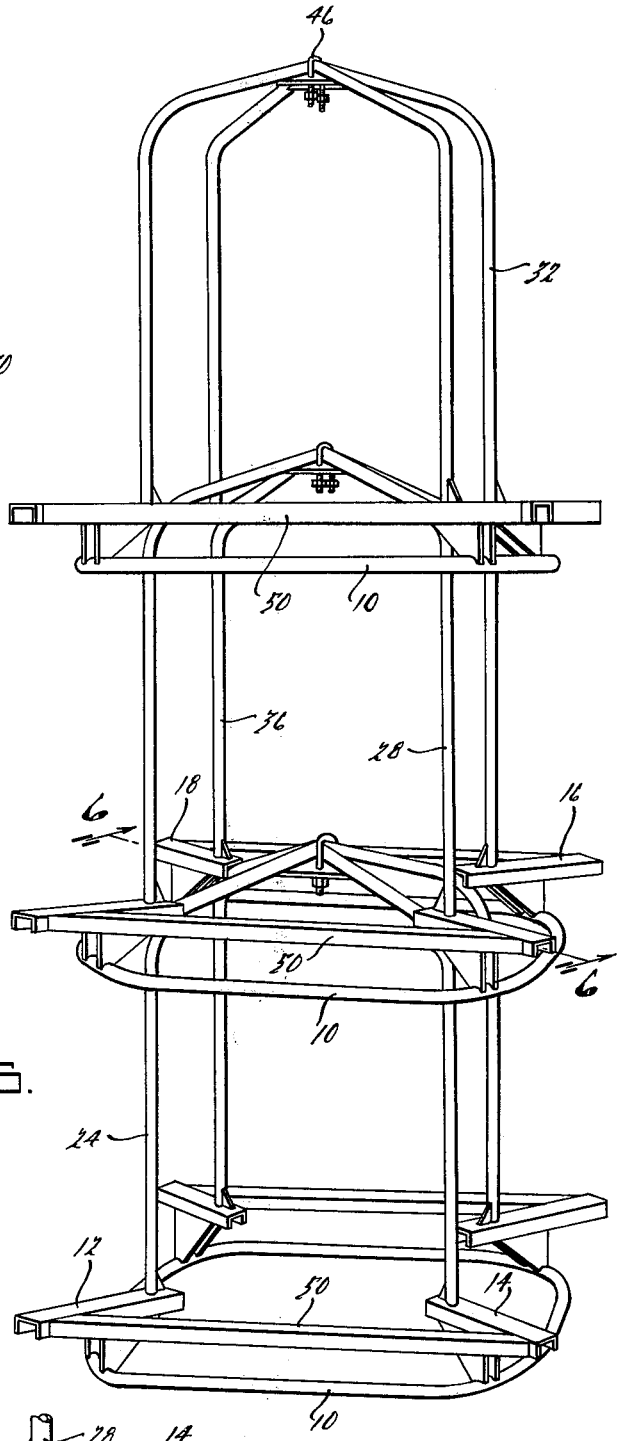
FIG. 5.
FIG. 6.
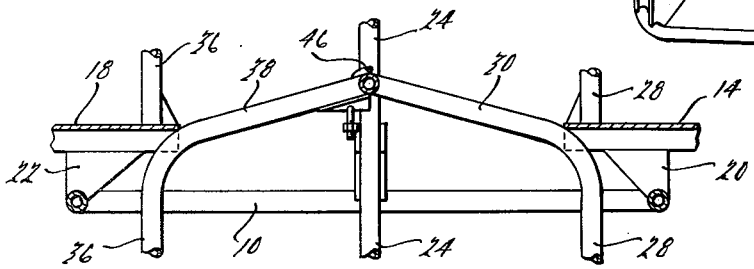

UNIVERSAL COIL CARRIER

BACKGROUND AND SUMMARY OF THE INVENTION

There are presently in use a number of different types of coil carriers for handling metal tubing of the type used for automotive brake lines and fuel lines, refrigeration heat exchangers and coils, and like applications. Many are expensive and complex. Some stack and others nest, but insofar as applicant is aware none are capable of both. Certain known carriers require separate strapping of the coils disposed thereon, and others are of such a configuration that they are not usable with conventional conveyors, such as roller conveyors. Furthermore, in the coiling of tubing it is a conventional practice to coil the tubing as it is fabricated on a first type of coil carrier using an automatic coiler, and thereafter transfer the tubing from the first carrier to a second type of carrier for testing shipment and storage. Subsequent processing by the tubing customer often requires additional transfers of the tubing to yet different carriers.

It is therefore a primary object of the present invention to provide a relatively simple and lightweight coil carrier of universal application which overcomes the aforesaid disadvantages of known prior carriers, including providing a carrier which is capable of cooperating with a conventional automatic coiler to receive coils of tubing or the like as they are formed and thereafter carry them through all subsequent testing, shipping and storage phases, as well as through at least the initial operations performed thereon by the tubing customer, whereupon the carrier may be returned to the tubing manufacturers for reuse. A related object resides in the provision of coil carriers which are relatively lightweight, which may be stacked on one another in a stable fashion, whether loaded with coils or not, and which also may be nested with respect to one another, loaded or unloaded, thereby facilitating economical storage and shipping by requiring a minimum of space and handling. Another related object resides in the provision of such a carrier which is ideally suited for an automated coil handling system.

A further object of the invention concerns the provision of a coil carrier adapted to receive a single coil of tubing or the like, thereby eliminating the need for the separate strapping of individual coils.

Yet another object of this invention resides in the provision of a coil carrier which may be readily transported on most conventional conveyors, including roller conveyors, thus greatly facilitating coil handling.

BRIEF DESCRIPTION OF THE DRAWINGS

FIG. 4 is a perspective view illustrating a plurality of the carriers of FIG. 1 arranged in a nested relationship with one another;

FIG. 5 is a perspective view of a plurality of the carriers of FIG. 1 stacked on one another; and FIG. 6 is a fragmentary sectional view, with parts broken away, taken substantially along line 6—6 in FIG. 5.

DESCRIPTION OF THE PREFERRED EMBODIMENT

Figure 1:
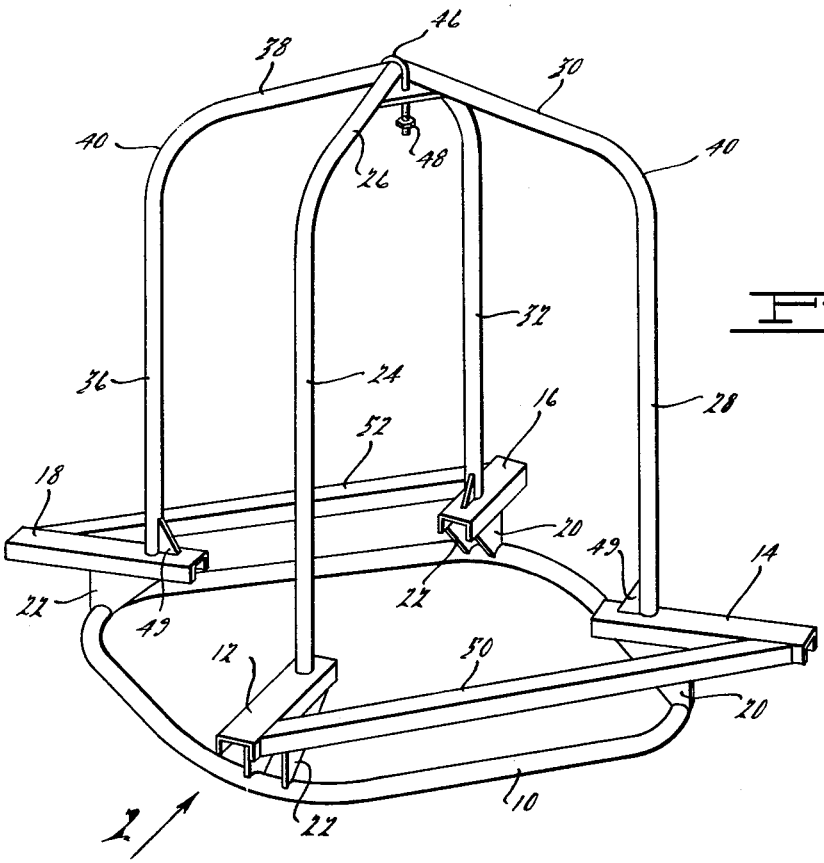
FIG. 1 is a perspective view of a coil carrier embodying the principles of the present invention.

The overall construction of the coil carrier of the present invention is best illustrated in FIG. 1 wherein it can be seen to comprise a base 10 of welded tubular construction having a generally square configuration in plan with rounded corners, and being entirely open in the center. Equally spaced about the circumference of base 10 and disposed slightly above each of the corners thereof are support elements 12, 14, 16 and 18, each of which extends radially (with respect to the central vertical axis of the carrier) and is formed from a channeled member, the recessed portion of the channel facing downwardly. The tops of each of the support elements lie in a common plane parallel to the plane of base 10, and each of the support elements is connected to base 10 by means of a pair of welded brackets 20 and 22, each of which is welded at the top to one of the support elements and at the bottom to base 10. Brackets 20 and 22 have the configuration illustrated so that they can support each of the support elements in such a way that the radially inner portion of each support element overlies the central opening in base 10.

The radially inner portion of support element 12 has welded to the top thereof a vertically extending member 24 having at the upper end thereof an integrally formed guide portion 26 which extends slightly upwardly and radially inwardly to the central vertical axis of the carrier. Support element 14 is provided with an identically constructed and contoured vertical member 28 and guide portion 30, support element 16 with an identical vertical member 32 and guide member 34, and support element 18 with an identical vertical member 36 and guide member 38. If desired, reinforcing webs 49 may be welded between the support elements and vertical members, in the manner shown. The inner ends of guide members 26, 30, 34 and 38 are welded together at the center of the carrier. The juncture of each of the guide portions and its corresponding vertical member is rounded, as indicated at 40, in order to facilitate the coiling of tubing or the like around each of the vertical members, it being contemplated that the carrier of the present invention will be placed on the turntable of a conventional automatic coiler. It should be noted that the imaginary vertical cylinder defined by the four vertical members is disposed wholly within the opening in base 10.

Figure 3:
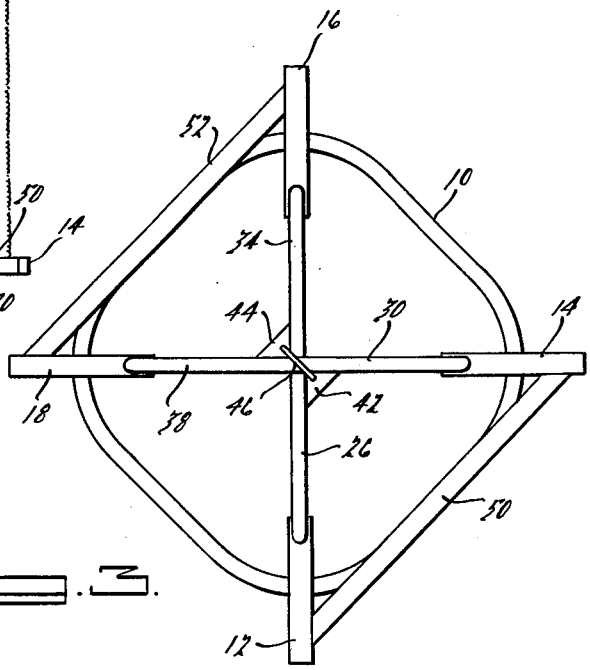
FIG. 3 is a top plan view of the coil carrier of FIG. 1.

Welded to the apex of guide portions 26 and 30, in the manner best illustrated in FIGS. 1 and 3, is a small triangular plate 42 having an aperture therethrough. A similar small triangular plate 44 is welded between guide members 34 and 38 at the apex thereof, plate 44 also having a small aperture therethrough. Disposed within these apertures are the legs of a downwardly open U-bolt 46 having lock nuts or like fasteners 48 on the legs thereof spaced downwardly from plates 42 and 44. U-bolt 46 functions as a lifting hook when it is desired to move the carrier by means of an overhead crane, chainfall or the like, the load being transferred from the U-bolt to the carrier by means of the engagement of nuts 48 on plates 42 and 44. When not in use, U-bolt 46 nests against the top of the carrier in the manner illustrated.

The outer ends of support elements 12 and 14 have welded therebetween a support arm 50 of box construction. A similar support arm 52 is welded between support elements 16 and 18. Each of the support arms overlies and is generally parallel to the portion of the base disposed therebelow. They are also spaced from the base so that a transverse through-opening extends through the carrier between base 10 and arms 50 and 52, which space is adapted to receive the lifting forks of a conventional fork-lift truck if and when it is desired to move the carrier by that type of conveyance. Because base 10 is generally flat on the bottom and has a continuous uninterrupted periphery, the carrier is also ideally suited for transportation on most types of conveyors, including roller conveyors.

The manner in which the coil carriers of the present invention are nested together to facilitate storage of a large number of carriers in a relatively small space is clearly illustrated in FIG. 4. As can be seen, the base of each carrier rests on the support elements of the carrier disposed immediately therebelow, with the vertical members of the latter extending through the central opening of the upper carrier, the vertical members of the upper carrier being slightly rotationally displaced about the center axis of the carrier with respect to the vertical members of the carrier disposed immediately below to provide clearance. This relationship exists for all adjacent carriers in the nested stack. If desired, the coil carriers may also be similarly nested even though partially or wholly loaded with tubing, in which case the base of each upper carrier would rest upon the top of the load on the next lowermost carrier. If it is desired to move an entire stack of nested carriers such may be easily accomplished by inserting the lifting forks of a conventional lift truck between the support arms and base of the lowermost carrier. Carriers may also be individually removed using lifting hook 46.

In FIG. 5 a plurality of carriers embodying the principles of the present invention are illustrated in a stacked relationship. As can be seen best in FIG. 6, the geometry of each carrier is such that the radially extending recesses on the lower surfaces of the inner portions of each of the support elements rests upon the top of the guide portions of the next lowermost carrier. Because of the interlocking nesting relationship of the support elements and guide portions at a plurality of of points and along lines at right angles to one another, the resulting stack is quite stable and resistant to transverse displacement of one carrier with respect to another. It is contemplated that loaded coil carriers will generally be held in storage by stacking loaded coil carriers in the manner illustrated in FIG. 5 in order to conserve space. When it is desired to move the coils from the stack or to move the entire stack, such may be easily accomplished by use of a fork-lift truck in the manner previously described. Individual carriers may also be removed from the top of the stack using lifting hook 46.

Figure 2:
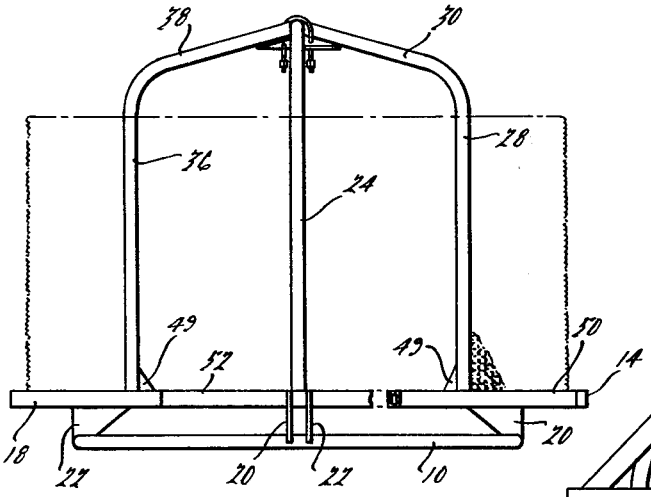
FIG. 2 is a side elevational view of the coil carrier of FIG. 1, looking in the direction of arrow 2 in FIG. 1, and showing a loaded coil in phantom lines.

The typical loading of a coil carrier is illustrated in phantom lines in FIG. 2. Obviously the carriers can be constructed of any shape or design in accordance with the requirements of the particular application at hand, so long as the basic interrelationships of the parts described herein are maintained. The height and width of the coil carrier are two dimensions in which there is a great deal of flexibility in design, for the particular use contemplated. Also, the carrier is easily fabricated from standard pipe or tubing and other conventional, readily available, inexpensive structural members.

The coil carrier of this invention is ideally suited for use on the turntable of a conventional automated coiler or uncoiler, which takes continuously fabricated tubing from the source of manufacture and wraps it in a spiral coil and then deposits it on a coil carrier in a continuous operation. The slightly conical top configuration of the present carrier is designed for use with coilers and uncoilers of the type with which applicant is familiar, however, to facilitate coiling this configuration can be altered to suit other types of coilers and uncoilers. Because the base of the carrier is noncircular it is a very easy matter to provide stops on the coiler/uncoiler turntable in order to prevent relative rotation of the carrier and turntable.

Thus, there is disclosed in the above description and in the drawings an embodiment of the invention which fully and effectively accomplishes the objects thereof. However, it will be apparent that variations may be indulged in without departing from the sphere of the invention herein described or the scope of the appended claims.

I claim:

1. A coil carrier comprising:

a. a base having a central opening;

b. a coil receiving portion disposed above said base, said coil receiving portion having a lower generally vertical portion adapted to have coils of tubing or the like wrapped therearound and being of a size and shape to fit within the central opening of another similar carrier when the latter is disposed thereabove in nested relationship, and an upper generally horizontal portion; and c. support means positioned on said carrier and extending radially inwardly to a position overlying said central opening, said support means being adapted to rest upon said upper portion of the coil receiving portion of another similar carrier when stacked on the latter.

2. A coil carrier as claimed in claim 1, wherein said support means are mounted on said base and support said coil receiving portion.

3. A coil carrier as claimed in claim 2, further comprising lifting fork engaging means affixed to said support means.

4. A coil carrier as claimed in claim 1, wherein said upper portion of the coil receiving portion comprises a plurality of inwardly directed tubular members, and said support means comprises a plurality of downwardly open channel members adapted to receive said tubular members when similar carriers are stacked on one another.

5. A coil carrier comprising:

a. a base having an enlarged central opening centered about the central vertical axis of the coil carrier;

b. a plurality of radially extending support elements mounted on said base and circumferentially spaced at intervals therearound, each said support element having an inner portion overlying said central opening, and an outer portion extending radially outwardly therefrom;

c. a vertical member attached to the top of said inner portion of each said support element and extending generally vertically therefrom, the imaginary vertical cylinder defined by said vertical members being disposed wholly within said central opening, said vertical members being adapted to have coils of tubing or the like coiled therearound and resting on said support elements;

d. a guide portion at the upper free end of each of said vertical members, each said guide portion extending radially inwardly and slightly upwardly; and e. a radially extending recess on the lower surface of each of said inner portions of said support elements, whereby coil carriers of identical construction may be stacked on one another with said recesses on an upper carrier resting on said guide portions of a lower carrier, or may be nested with respect to one another with the base of an upper carrier resting on the support elements of a lower carrier with the vertical members of the lower carrier extending through the central opening of the upper carrier, the vertical members of the upper carrier being rotationally displaced about said center axis with respect to the vertical members of the lower carrier.

6. A coil carrier as claimed in claim 5, wherein said guide portions are formed of tubing and said support elements comprise downwardly open channel members having a channel width greater than the diameter of said tubing.

7. A coil carrier as claimed in claim 5, wherein four support elements and four vertical members are provided, disposed at equally spaced intervals around the circumference of said base.

8. A coil carrier as claimed in claim 5, wherein said base is non-circular in plan.

9. A coil carrier as claimed in claim 5, further comprising a support arm connected between said outer portions of two adjacent support elements, said support arm being disposed generally parallel to and spaced above said base, whereby lifting forks may be inserted therebetween to lift the coil carrier.

10. A coil carrier as claimed in claim 9, wherein two said support arms are provided, disposed on opposite sides of the carrier.

11. A coil carrier as claimed in claim 5, further comprising lifting hook receiving means attached to said guide portions in the vicinity of said center axis.

12. A coil carrier as claimed in claim 5, wherein each said guide portion is connected at its upper free end to each of the other guide portions in the vicinity of said axis.

13. A coil carrier comprising:

a. a base having an enlarged central opening centered about the central vertical axis of the coil carrier;

b. a plurality of radially extending support elements mounted on said base and circumferentially spaced at equal intervals therearound, each said support element having an inner portion overlying said central opening, and an outer portion extending radially outwardly therefrom;

c. a vertical member attached to the top of said inner portion of each said support element and extending generally vertically therefrom, the imaginary vertical cylinder defined by said vertical members being disposed wholly within said central opening, said vertical members being adapted to have coils of tubing or the like coiled therearound and resting on said support elements;

d. a guide portion formed integrally with the upper free end of each of said vertical members, each said guide portion extending radially inwardly and slightly upwardly, and being connected at its upper free end to each of the other guide portions at a point disposed on said axis;

e. a radially extending recess on the lower surface of each of said inner portions of said support elements, whereby coil carriers of identical construction may be stacked on one another with said recesses on an upper carrier resting on said guide portions of a lower carrier, or may be nested with respect to one another with the base of an upper carrier resting on the support elements of a lower carrier with the vertical members of the lower carrier extending through the central opening of the upper carrier, the vertical members of the upper carrier being rotationally displaced about said center axis with respect to the vertical members of the lower carrier;

f. a support arm connected between said outer portions of two adjacent support elements, said support arm being disposed generally parallel to and spaced above said base, whereby lifting forks may be inserted therebetween to lift the coil carrier; and g. lifting hook receiving means attached to said guide portions in the vicinity of said center axis.

14. A coil carrier comprising:

a. a base having an enlarged central opening centered about the central vertical axis of the coil carrier;

b. a plurality of radially extending support elements mounted on said base at circumferentially spaced intervals therearound and extending radially inwardly to a position overlying said central opening;

c. a plurality of vertical members attached to the carrier and extending generally vertically above said base, the imaginary vertical cylinder defined by said vertical members being disposed wholly within said central opening, said vertical members being adapted to have coils of tubing or the like coiled therearound; and d. a guide portion disposed at the upper free end of each of said vertical members, whereby coil carriers of identical construction may be stacked on one another with said support elements on an upper carrier resting on said guide portions of a lower carrier, or may be nested with respect to one another with the base of an upper carrier resting on the support elements of a lower carrier with the vertical members of the lower carrier extending through the central opening of the uppper carrier.

* * * * *